US005198828A

United States Patent [19]

West et al.

[11] Patent Number: 5,198,828

[45] Date of Patent: Mar. 30, 1993

[54] MICROWAVE RADAR ANTENNA AND METHOD OF MANUFACTURE

[75] Inventors: James B. West, Cedar Rapids; Roger D. Anderson, Marengo; Gary Sampson, Cedar Rapids; Andrew Yarne, Marion, all of Iowa

[73] Assignee: Rockwell International Corporation, Seal Beach, Calif.

[21] Appl. No.: 752,106

[22] Filed: Aug. 29, 1991

[51] Int. Cl.[5] ..... H01Q 13/00

[52] U.S. Cl. ..... 343/776; 343/771; 343/777

[58] Field of Search ..... 343/771, 776, 777

[56] References Cited

U.S. PATENT DOCUMENTS 2,698,421 12/1954 Kline et al. ..... 333/73
3,408,597 10/1968 Heiter ..... 333/24.1
4,255,752 3/1981 Noble et al. ..... 343/771
4,303,898 12/1981 Kinsey et al. ..... 333/114
4,845,448 4/1989 Olsson ..... 333/254

*Primary Examiner*—John D. Lee
*Assistant Examiner*—Robert E. Wise
*Attorney, Agent, or Firm*—Gregory G. Williams; M. Lee Murrah; H. Fredrick Hamann

[57] ABSTRACT

An improved microwave radar antenna including a plurality of linear waveguides arranged in a two dimensional array with each linear waveguide having a mounting flange along the bottom narrow edge of the waveguide for attachment to the ground plane of the antenna by the conductive epoxy. Also disclosed is a method of manufacturing an improved microwave antenna where flanged linear waveguides are milled to provide for radiator slots and then are affixed to a attentive ground plane along the flanged edge of the waveguide by a conductive epoxy.

3 Claims, 2 Drawing Sheets

MICROWAVE RADAR ANTENNA AND METHOD OF MANUFACTURE

BACKGROUND OF THE INVENTION

This invention generally relates to antennas, and more particularly concerns, microwave radar antennas, and even more particularly concerns a two dimensional array of linear thin walled extruded waveguides with mounting flanges on their bottom narrow edge wall, arranged to function as a microwave radar antenna.

In the past, avionics engineers have been given the task of designing microwave radar antennas for aircraft weather radars. These antennas need to meet strict electrical performance criteria while being lightweight and mechanically durable and rigid. Designers have attempted to reduce weight by using thinner walled waveguides, but often at the expense of electrical performance and the precision; mechanical placement of the slots within the waveguide, the waveguide to waveguide registration to the ground plane, and the registration of the linear alloy waveguides on the ground plane and the feed manifold attached to the back of the ground plane.

Consequently, there exists a need for improvement in radar antennas.

SUMMARY OF THE INVENTION

It is an object of the present invention to provide a mechanically rigid, light weight, tight mechanical tolerance high performance radar antenna.

It is a feature of the present invention to include a two dimensional array of narrow edge wall flange waveguides affixed at their flanges to a ground plane.

It is an advantage of the present invention to allow for thin wall waveguides while concomitantly provided sufficient mechanical rigidity and electrical performance.

It is another object of the present invention to minimize heat stress of the antenna during construction.

It is another feature of the present invention to use flanges as mounting flanges to a ground plane.

It another advantage of the present invention to allow for low or non-heat stress mechanical joints between individual waveguides and the ground plane.

It is yet another object of the present invention to provide high electrical performance.

It is yet another feature of the present invention to include registration holes in the flanges and the ground plane.

It is yet another advantage of the present invention to allow for more precise alignment of individual linear arrays of waveguides onto the ground plane.

The present invention provides an improved microwave antenna which is designed to satisfy the aforementioned needs, produce the above described objects, include the previously discussed features and achieve the already articulated advantages.

The present invention is a "heat stress-less" antenna, in the sense that, the heat stress typically associated with dip brazing, soldering or spot welding the waveguides to the ground plane are greatly reduced. Instead, the present invention provides mechanical rigidity through the flanged bottom narrow edge wall and provides for attachment by a non or low heat stress method such as conductive epoxy and or limited soldering or spot welding.

Accordingly, the present invention includes a radar antenna including an array of waveguides each having a flanged bottom narrow bottom edge wall, fixed to an antenna ground plane by a low heat stress methods. The present invention also includes a method of manufacturing microwave radar antennas including the steps of: providing several waveguides with flanged bottom narrow edge walls, milling individual radiator slots in the waveguides, punching holes in the flanges of the individual waveguides and the ground plane so that pins may be disposed therein and thereby allowing for the accurate registration of the waveguides to the ground plane and consequently resulting in enhancing electrical performance, affixing the waveguides to the ground plane by conductive epoxy or other low or non heat stress methods.

BRIEF DESCRIPTION OF THE DRAWINGS

The invention will be best understood by a reading of the detailed description in conjunction with the appended drawings in which.

DETAILED DESCRIPTION OF THE DRAWINGS

Figure 1:
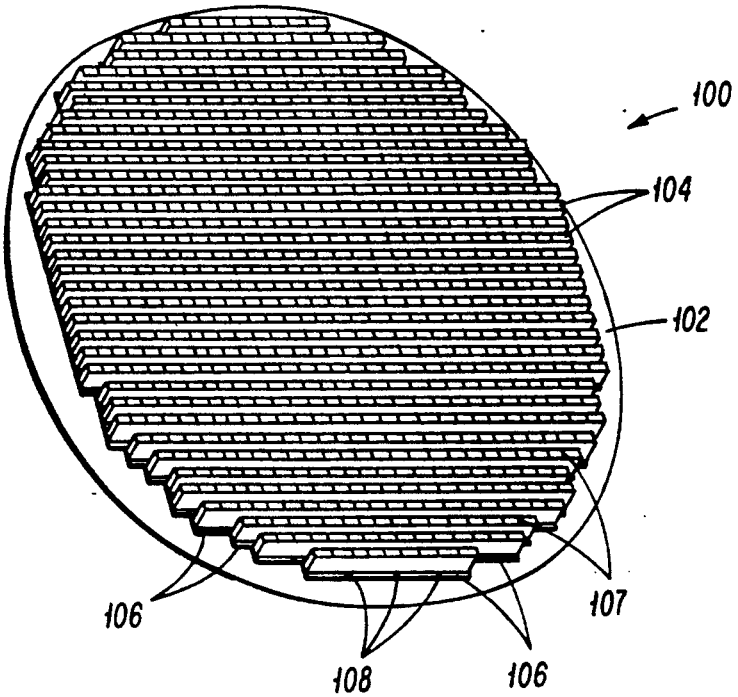
FIG. 1 is a perspective view of the microwave radar antenna of the present invention including a two dimensional array of linear flange waveguides disposed on a ground plane.

Now referring to the FIGURES, where like numbers refer to like structures throughout the text and the drawings, and more particularly referring to FIG. 1, there is shown an improved microwave antenna of the present invention, generally designated 100, which includes a ground plane 102 with a two dimensional array of linear waveguides 104 disposed thereon. Waveguides 104 are shown having radiator slots 107 on their top narrow edge wall and flanges 106 on the bottom narrow edge walls. Also shown in flanges 106 are registration pins 108.

Figure 2A:
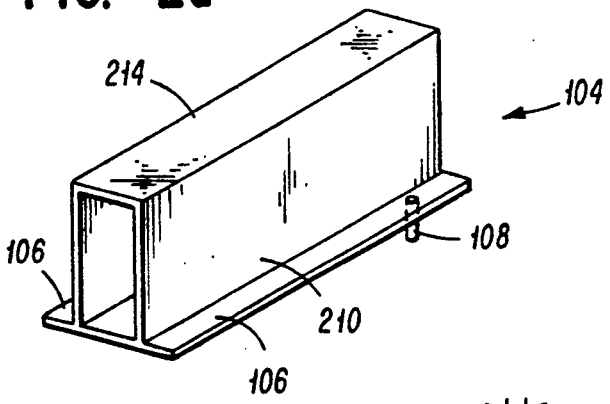
FIG. 2A is a perspective view of a single flanged waveguide mounted on a ground plane with registration pins.
Figure 2B:
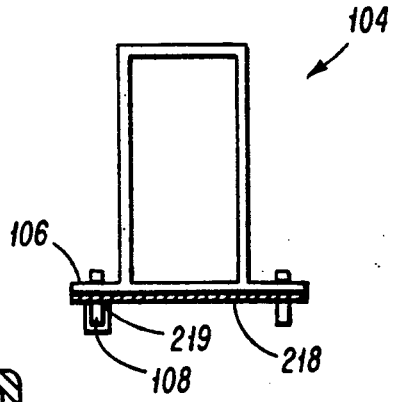
FIG. 2B is a cross sectional view of a single flanged waveguide mounted on a ground plane with registration pins.

A more thorough understanding of the present invention may be achieved by now referring to FIG. 2A which shows a perspective view of a single waveguide 104 mounted on ground plane 102. Waveguide 104 is shown having a flange 106 on each side. Waveguide 104 is also shown having a first broad wall 210 and a second broad wall 212 which are required parallel and separated and connected by top narrow edge wall 214 and bottom narrow edge wall 216. Flange 106 is shown having a pin 108 extending therethrough into hole 219 in the ground plane 102. FIG. 2B is a cross sectional diagram of the waveguide 104 disposed on the ground plane 102. Also shown, in a preferred embodiment, is a conductive epoxy 218 for mechanically and electrically connecting waveguide 104 to ground plane 102.

Figure 3:
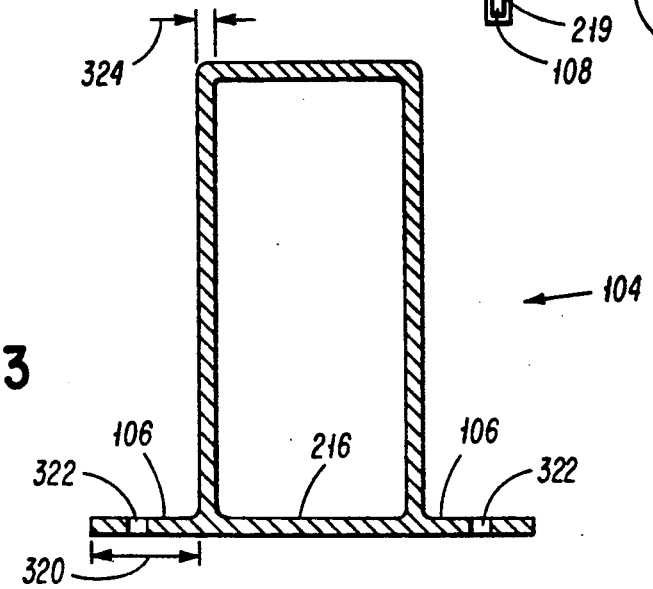
FIG. 3 is a cross sectional detailed drawing of preferred waveguide used in the antenna of the present invention.

Now referring to FIG. 3 there is shown a preferred embodiment of the present invention including a wave guide 104. Preferable the waveguide 104 is a single extruded piece of aluminum alloy, such as AL 6061 or 6063, generally having a rectangular cross section, except for the flanges 106 on the bottom narrow edge wall 216. Preferrably dimension 320 is sufficient to provide for registration hole 322 to be punched therethrough and to provide for necessary stability of the waveguide when placed on the ground plane 102 (FIGS. 1, 2A and 2B, and further must provide sufficient surface area for bonding agents to adhere. Punching holes 322 through flanges 106 is preferred for accuracy purposes. However, other suitable methods such as drilling, etching, etc. may be used. In a preferred embodiment for X band antennas, the dimensions 324 of the thickness of the walls is 20 mils. Of course other dimensions may be used for the same or other bands depending on the particular requirements for any particular antenna.

Figure 4:
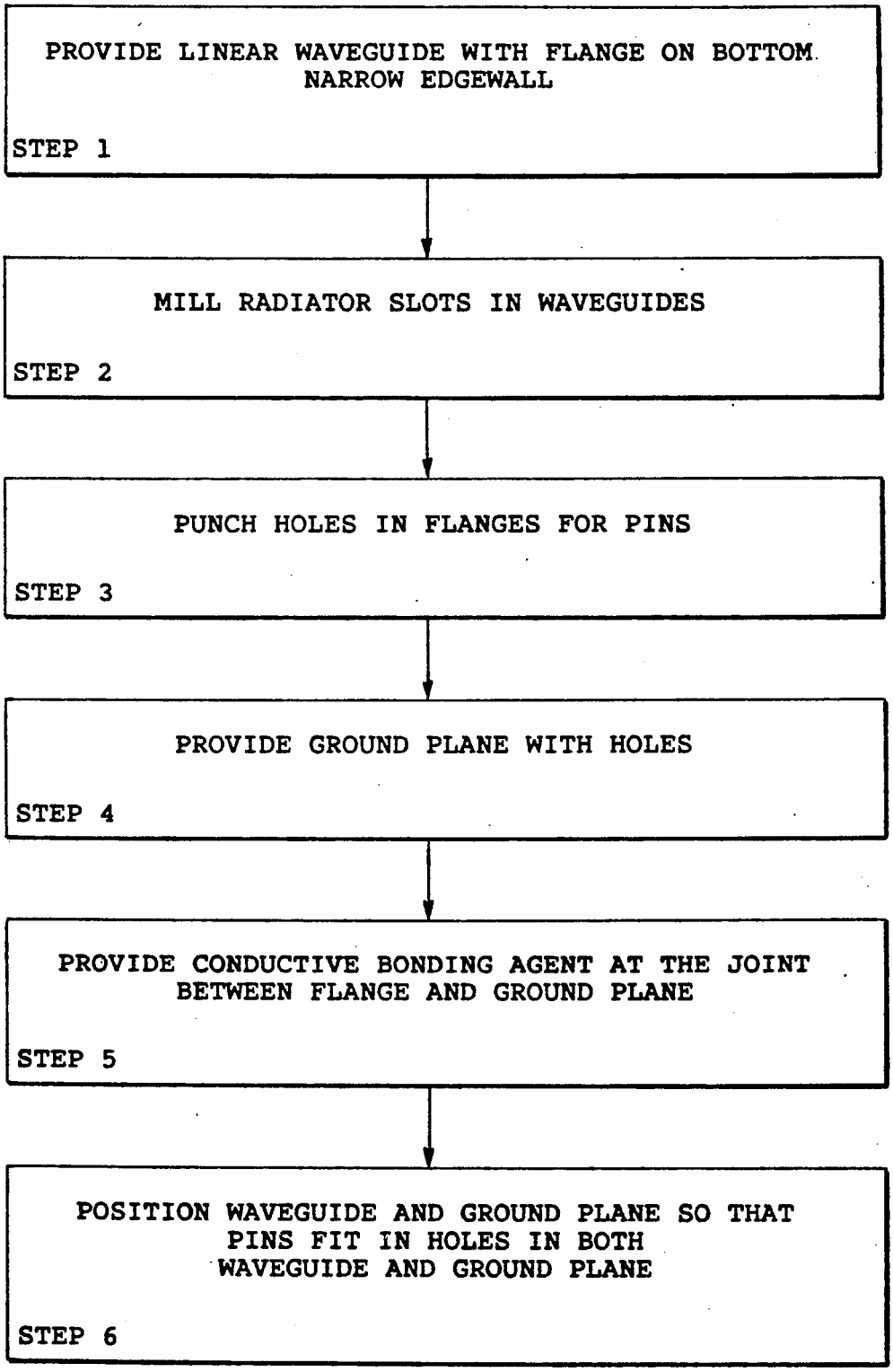
FIG. 4 is a flow chart of the preferred steps of the process of manufacturing the antenna of the present invention.

Now referring to FIG. 4 there is shown a flow chart of manufacturing the antenna of the present invention having the steps of:

(1) Providing several linear waveguides 104 of a generally rectangular cross section with flanges on the bottom narrow edge wall. Preferrably the waveguide is a single extruded piece of aluminum or suitable alloy. Preferrably, perpendicularity of two adjacent interior waveguide surfaces shall not exceed 0.008 inch when measured at each waveguide length. Preferrably twists along the longitudinal axis of the waveguide shall not exceed one degree per foot of length on the face of interior or exterior surfaces. Preferrably, bow between any two points two feet apart on the concave external surface shall not be more than 0.010 on the narrow surface and 0.020 on the wide surface.

(2) Precisely mill several radiator slots along the top narrow edge wall of each waveguide at predetermined locations.

(3) Punch holes 322 through flanges 106 of waveguide 104 at predetermined locations.

(4) Provide a ground plane 104 and punch holes 219 at predetermined locations. While steps 2, 3 and 4 discuss milling, and punching of the waveguide these are merely preferred methods and other well known methods of accomplishing the same result may be substitute.

(5) Provide a conductive bonding agent 218 at the joint between flange 106 and the ground plane 102. Preferable conductive bonding agent 218 is a silver epoxy or other conductive epoxy.

(6) Position waveguide 104 on to ground plane 102, so that, pins 108 extend through holes 322 in waveguide 104 and into holes 219 in ground plane 102, thereby providing for registration of the waveguide 104 to the ground plane 102 and further so that, the bonding agent adheres to both waveguide 104 and ground plane 102.

The improved microwave radar antenna, of the present invention, and many of its attendant advantages will be understood from the foregoing description and it will be apparent that various changes may be made in the form, construction, and arrangement of the parts, without departing from the spirit and scope of the invention, or sacrificing all of their material advantages, the form herein being merely a preferred or exemplary embodiment thereof.

We claim:

1. An improved radar antenna including:

a ground plane having a plurality of ground plane holes therein at predetermined locations;

a plurality of center fed waveguides, each having a flange on its bottom narrow edge wall;

said flange having a plurality of flange holes therein at predetermined locations;

said waveguide means affixed along said flange to said ground plane with a conductive bonding agent;

at least one indexing pin disposed through one of said flange holes and through one of said ground plane holes.

2. A method of manufacturing a radar antenna comprising the steps of:

providing a plurality of linear center fed waveguides having flanges thereon;

precisely milling several radiator slots in the waveguides;

punching flange holes through the flange of said waveguide at predetermined locations;

providing a ground plane with ground plane holes punched therein at predetermined locations;

providing a conductive bonding agent between said flange and said ground plane; and, providing at least one indexing pin through one of said flange holes and one of said ground plane holes.

3. An improved microwave phased array weather radar antenna comprising:

an antenna ground plane having a plurality of ground plane holes punched therein at predetermined locations;

a plurality of linear center fed waveguides, each having a bottom narrow edge wall with a flange thereon;

said flange having a plurality of flange holes therein at predetermined locations;

said plurality of linear waveguides disposed on said antenna ground plane in a two dimensional array, with each of said waveguides being affixed to said ground plane by a conductive bonding agent disposed therebetween; and, said ground plane and said flange of each waveguide of said plurality of waveguides having at least two indexing pins disposed therethrough.

* * * * *